US007029237B2

(12) United States Patent
Follonier et al.

(10) Patent No.: US 7,029,237 B2
(45) Date of Patent: Apr. 18, 2006

(54) RETENTION CAPACITY OF BLADE HAVING AN ASYMMETRICAL HAMMERHEAD CONNECTION

(75) Inventors: Christophe Follonier, Saint Fargeau Ponthierry (FR); Claude Lejars, Draveil (FR); Jérôme Mace, Melun (FR); Bruce Pontoizeau, Paris (FR); Patrick Reghezza, Vaux le Penil (FR)

(73) Assignee: Snecma Moteurs, Paris (FR)

( * ) Notice: Subject to any disclaimer, the term of this patent is extended or adjusted under 35 U.S.C. 154(b) by 94 days.

(21) Appl. No.: 10/879,744

(22) Filed: Jun. 30, 2004

(65) Prior Publication Data

US 2005/0008491 A1 Jan. 13, 2005

(30) Foreign Application Priority Data

Jul. 7, 2003 (FR) ..... 03 08295

(51) Int. Cl.
*F04D 29/34* (2006.01)

(52) U.S. Cl. ..... 416/215; 416/219 R

(58) Field of Classification Search ..... 416/219 R, 416/215, 216, 220 R, 204 A
See application file for complete search history.

(56) References Cited

U.S. PATENT DOCUMENTS 3,165,294 A 1/1965 Anderson
5,584,658 A * 12/1996 Stenneler ..... 416/215

FOREIGN PATENT DOCUMENTS

EP 0 695 856 A1 2/1996
FR 2 504 975 11/1982
FR 2 571 099 4/1986

* cited by examiner

*Primary Examiner*—Edward K. Look
*Assistant Examiner*—Dwayne J White
(74) *Attorney, Agent, or Firm*—Oblon, Spivak, McClelland, Maier & Neustadt, P.C.

(57) ABSTRACT

The invention relates to a method of improving the retention capacity of a blade having an asymmetrical hammerhead connection and extending in a conical stream, with the root of the blade being retained in a peripheral groove in a disk, said groove having an upstream lip and a downstream lip presenting respective bearing surfaces that extend in planes that are asymmetrical relative to planes perpendicular to the axis of rotation of said disk, and against which the surfaces of the upstream and downstream flanks of said root come to bear, the bearing surface of said upstream lip being connected to the bottom wall of said groove via a rounded surface, and the upstream flank presenting, in the vicinity of said rounded surface, a heel situated inside a circle of radius R centered on the axis about which said blade tends to pivot when axial stress is applied thereto, said circle outlining, in the upstream lip, a crescent shape of thickness e, wherein:

a) the connection between the bearing surface of the upstream lip and the bottom wall of the groove is modified by removing material from said disk; and b) said disk is fitted with blades in which the upstream flanks present respective heels of greater volume so as to increase the value of the radius R and the value of the thickness e.

1 Claim, 2 Drawing Sheets

RETENTION CAPACITY OF BLADE HAVING AN ASYMMETRICAL HAMMERHEAD CONNECTION

The invention relates to the bladed disks of a turbomachine that are placed in a conical stream, such as those forming the last stages of a low-pressure compressor in a two-spool bypass turbojet having a large dilution ratio.

BACKGROUND OF THE INVENTION

In turbojets having a large dilution ratio, the radius of the primary flow stream decreases from upstream to downstream through the low-pressure compressor. The conical shape of this stream is very marked in the last stages. The blades in these stages extend obliquely into the stream relative to the plane perpendicular to the axis of rotation of the compressor, i.e. obliquely relative to the direction of centrifugal force.

The invention relates more particularly to bladed disks of this type in which the blades are retained by hammerhead type connections in a peripheral groove of the disk, the groove being defined by an upstream lip and a downstream lip, the surfaces of the lips connected to the bottom of the groove forming bearing surfaces on which the flanks of the blade roots bear when the turbomachine is in operation, these bearing surfaces supporting reaction forces having a resultant that preferably lies in the plane of the centrifugal forces.

To achieve this result, EP 0 695 856 proposes an asymmetrical hammerhead connection, i.e. one in which the angle of the bearing surface of the larger-diameter front lip relative to a plane perpendicular to the axis of rotation is greater than the angle formed between the bearing surface of the downstream lip and said plane. FIG. 4B of that document shows the blade-disk connection for the situation in which the blade, on being subjected to high levels of axial stress, tends to pivot about the center of rotation C constituted by the end of the bearing surface of the downstream lip. Accompanying FIG. 1 reproduces FIG. 4A of EP 0 695 856. Reference 1 therein designates a blade whose root 2 is of dovetail type with an upstream flank 3*a* and a downstream flank 3*b* whose surfaces bear against the bearing surfaces 4*a* and 4*b* of the inside faces of an upstream lip 5 and of a downstream lip, which lips together define a groove 7 formed in the periphery of a disk 12, with the bottom wall 8 of the groove being connected to the bearing surfaces 4*a* and 4*b* via respective rounded surfaces 9*a* and 9*b*.

In the event of high levels of axial stress being applied by debris impacting against the aerodynamic portion of the blade 1, the blade tends to pivot about the upstream end C of the bearing surface B of the downstream lip 6. The end 10 of the upstream heel 11 of the root of the blade 1, located furthest from the center of rotation C, is stressed to describe a circle (C).

The bearing surface 4*a* of the upstream lip 5 is situated inside the circle (C), and the surfaces common to the circle (C) and to the section of the upstream lip 5 on a section plane containing the axis of rotation of the disk are crescent-shaped, with a maximum thickness e.

It will readily be understood that if the thickness e is small and if the angle A between the bearing surface 4*a* and the tangent to the circle (C) at the end 10 is also small, then deformations of the upstream lip 5 and of the heel 11, as a result of high levels of axial stress, can lead to the blade 1 escaping.

OBJECT AND SUMMARY OF THE INVENTION

The object of the invention is to improve the retention capacity of a blade having an asymmetrical hammerhead connection of the type described above.

More precisely, the invention provides a method of improving the retention capacity of a blade having an asymmetrical hammerhead connection and extending in a conical stream, with the root of the blade being retained in a peripheral groove in a disk, said groove having an upstream lip and a downstream lip presenting respective bearing surfaces that extend in planes that are asymmetrical relative to planes perpendicular to the axis of rotation of said disk, and against which the surfaces of the upstream and downstream flanks of said root come to bear, the bearing surface of said upstream lip being connected to the bottom wall of said groove via a rounded surface, and the upstream flank presenting, in the vicinity of said rounded surface, a heel situated inside a circle of radius R centered on the axis about which said blade tends to pivot when axial stress is applied thereto, said circle outlining, in the upstream lip, a crescent shape of thickness e.

In the method of the invention:

a) the connection between the bearing surface of the upstream lip and the bottom wall of the groove is modified by removing material from said disk; and b) said disk is fitted with blades in which the upstream flanks present respective heels of greater volume so as to increase the value of the radius R and the value of the thickness e.

BRIEF DESCRIPTION OF THE DRAWINGS

Other advantages and characteristics of the invention will appear on reading the following description made by way of example and with reference to the accompanying drawings, in which.

MORE DETAILED DESCRIPTION

Figure 2:
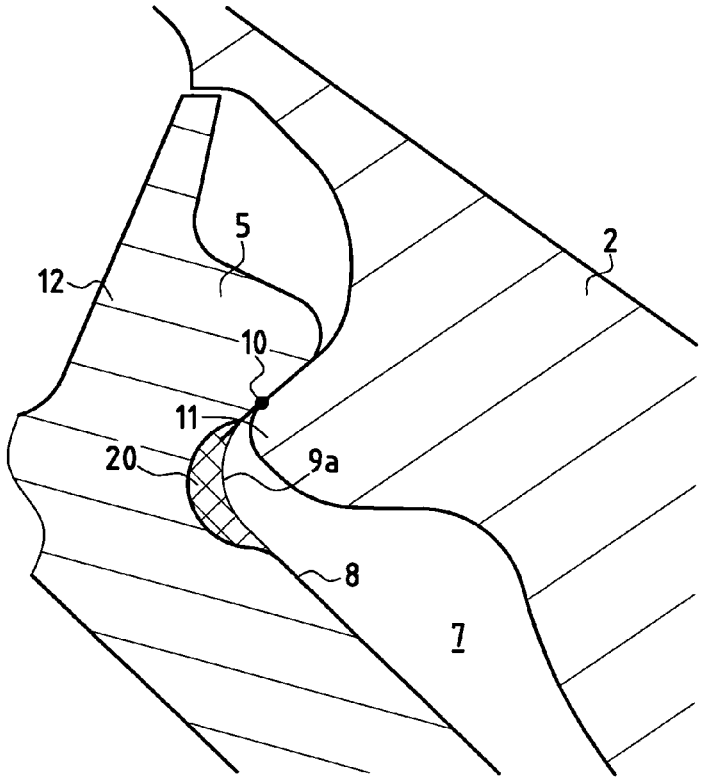
FIG. 2 is similar to FIG. 1, and shows the modifications applied to the groove of the disk in accordance with the invention.

In FIG. 2, cross-hatching referenced 20 shows the section of the material removed from the disk 12 in the connection zone 9*a* between the bearing surface 4*a* of the upstream lip 4 and the bottom wall 8 of the groove 7. This material can be removed by cutting or by milling, for example.

Figure 1:
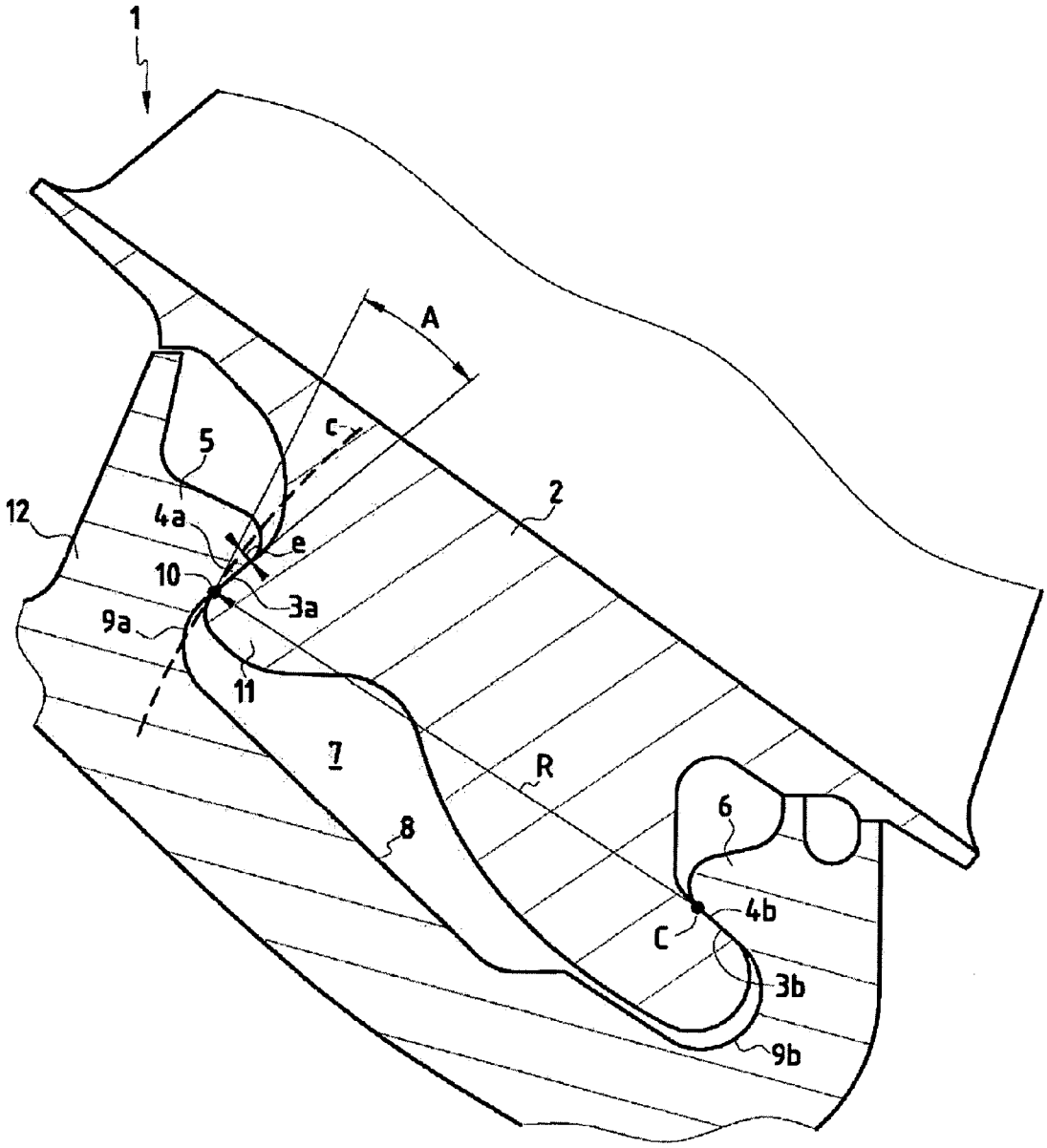
FIG.1 PRIOR ART
FIG. 1, described above, is a section on a plane containing the axis of rotation, showing the connection between a blade and a disk in the prior art in a strongly conical stream, when the blade presents a tendency to pivot out from the groove in the disk by the application of axial stress.
Figure 3:
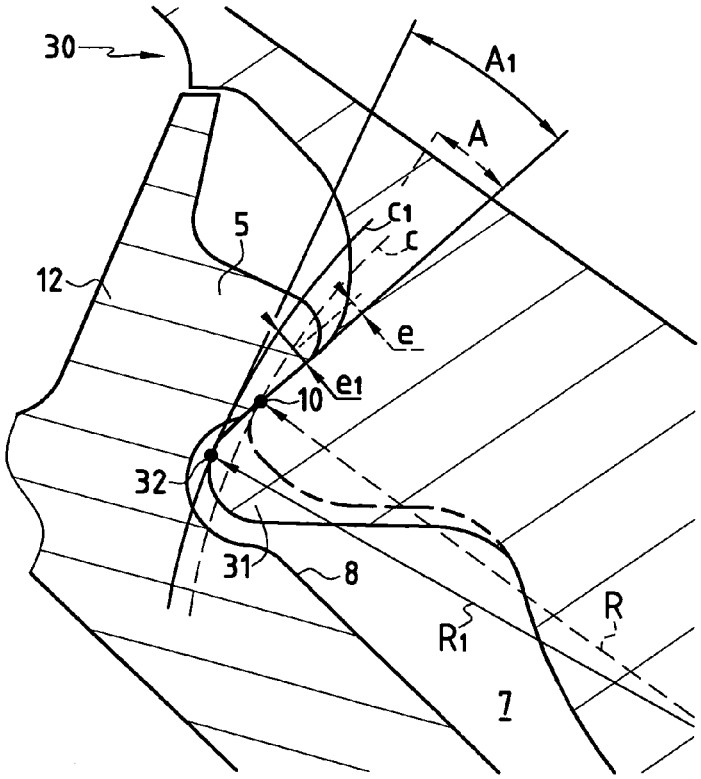
FIG. 3 shows the modifications applied to the root of the blade in accordance with the invention.

This removal of material increases the space available beneath the heel 11 of the prior art blade and enables the blade shown in FIG. 1 to be replaced by a new blade 30 as shown in FIG. 3, which blade presents a heel that is larger than the heel 11 of the prior art blade. Above from its heel 31, this blade 30 is identical to the blade 1. The dashed line in FIG. 3 shows the section of the prior art blade.

The point 32 on the heel 31 that is furthest from the center of rotation C is distant from said center by a distance R1 that is greater than R, and the circle (C1) of center C and of radius R1 defines a crescent shape in the lip 5 of thickness e1 greater than that of the crescent shape shown in FIG. 1, thereby very significantly improving the capacity for retaining the modified blade 1 in the modified groove of the disk 12.

FIG. 3 also shows that the angle A1 formed by the tangent to the circle (C1) at the point 32 and the bearing surface 4*a* of the upstream lip 5 is greater than the corresponding angle A in the prior art. FIG. 3 shows clearly that the small modifications made to the disk 12 and to the blade make it possible to increase significantly the magnitude of the angle A and the thickness e of the crescent shape.

What is claimed is:

1. A method of improving the retention capacity of a blade having an asymmetrical hammerhead connection and extending in a conical stream, with the root of the blade being retained in a peripheral groove in a disk, said groove having an upstream lip and a downstream lip presenting respective bearing surfaces that extend in planes that are asymmetrical relative to planes perpendicular to the axis of rotation of said disk, and against which the surfaces of the upstream and downstream flanks of said root come to bear, the bearing surface of said upstream lip being connected to the bottom wall of said groove via a rounded surface, and the upstream flank presenting, in the vicinity of said rounded surface, a heel situated inside a circle of radius R centered on the axis about which said blade tends to pivot when axial stress is applied thereto, said circle outlining, in the upstream lip, a crescent shape of thickness e, wherein:

a) the connection between the bearing surface of the upstream lip and the bottom wall of the groove is modified by removing material from said disk; and b) said disk is fitted with blades in which the upstream flanks present respective heels of greater volume so as to increase the value of the radius R and the value of the thickness e.

* * * * *